United States Patent [19]

Forget

[11] 4,033,366

[45] July 5, 1977

[54] UMBRELLA TENT

[76] Inventor: Léonel Forget, 161 Scott St., St. Jerome, Quebec, Canada

[22] Filed: Feb. 5, 1976

[21] Appl. No.: 655,379

[30] Foreign Application Priority Data

May 20, 1975 Canada ..... 227293

[52] U.S. Cl. ..... 135/2; 135/15 CF; 135/15 PQ; 135/36 F; 135/40

[51] Int. Cl.[2] ..... A45F 1/04; A45F 1/16

[58] Field of Search ..... 135/2, 15 CF, 15 PQ, 135/34, 36 R, 36 F, 36 RT, 40, 42; 2/89; 24/206, 201 HE

[56] References Cited

UNITED STATES PATENTS

| | | | |
|---|---|---|---|
| 33,752 | 11/1861 | Phillips | 2/89 |
| 79,963 | 5/1868 | Damerel | 135/40 |
| 1,583,831 | 5/1926 | Holgaard | 135/2 |
| 1,701,067 | 2/1929 | Fiuver | 135/36 RT |
| 3,874,397 | 4/1975 | Oberhaus | 135/2 |
| 3,929,146 | 12/1975 | Maiken | 135/34 X |

FOREIGN PATENTS OR APPLICATIONS

| | | | |
|---|---|---|---|
| 253,718 | 8/1966 | Austria | 135/40 |
| 579,505 | 7/1959 | Canada | 135/2 |
| 490,484 | 2/1954 | Italy | 135/2 |
| 677,448 | 8/1952 | United Kingdom | 135/2 |

*Primary Examiner*—Werner H. Schroeder
*Assistant Examiner*—Conrad L. Berman

[57] ABSTRACT

An umbrella tent of the type which has no hindering central post in the open position and which is characterized by having a removable central post extension which is used to produce opening of the tent and which also allows a simple construction of the framework components without the need for an actuation mechanism in addition to the basic framework components as heretofore done. This umbrella tent includes a central post, ribs pivoted to the upper end of the central post and spaced around the latter, an elongated post extension removably securable endwise to the lower end of the central post, a slidable underlying ring engaged around the central post and slidable along the latter and the post extension, a hook member to releasably hook this ring and hold the latter in fixed position along the central post, rods pivoted at their opposite ends to this ring and to an intermediate portion respectively of the ribs, and a spreader ring overlying the other ring and slidable along the central post and the post extension, whereby the spreader ring holds the ribs and rods in position of readiness for opening of the tent when the latter is closed and the post extension is upwardly cleared by the slidable underlying ring and is preferably removed when the tent is open.

1 Claim, 7 Drawing Figures

UMBRELLA TENT

This invention relates to umbrella tents and, in particular, to a tent of the type which opens and closes in generally the same manner as an umbrella and which has no center post restricting the internal floor space.

The umbrella tents of the above type which have been proposed so far are each provided with an actuation mechanism to effect opening and closing of the tent. Such mechanism is connected to the basic framework components, in addition thereto.

Such addition in itself involves added complexity, weight and cost, but it also imposes added complexity and cost in the construction of the framework components themselves. The factors of complexity, weight and cost must be taken in serious consideration in this art to produce a successively salable product.

It is a general object of the present invention to provide an umbrella tent of the above type, which is characterized by its simplicity of structure and operation and which is easy and rapid to install.

It is an object of the present invention to provide an umbrella tent of the above type which may be easily opened and closed by hand without addition of actuation mechanism to the basic framework components and wherein the latter are of simple construction and functional operation.

It is a more specific object of the present invention to provide an umbrella tent of the above type which includes a central post and a removable post extension wherein the latter is also used to produce the opening of the tent in addition to serving as a guide during the opening and closing, and to be entirely freed from removal thereof after the tent has been opened.

It is a further object of the present invention to provide an umbrella tent of the above type with a simple and efficient spreader device to hold the framework components in proper position of readiness for easy and simple opening action thereon.

The above and other objects and advantages of the present invention will be better understood with the following detailed description of a preferred embodiment thereof, which is illustrated, by way of example in the accompanying drawings, in which.

Figure 1:
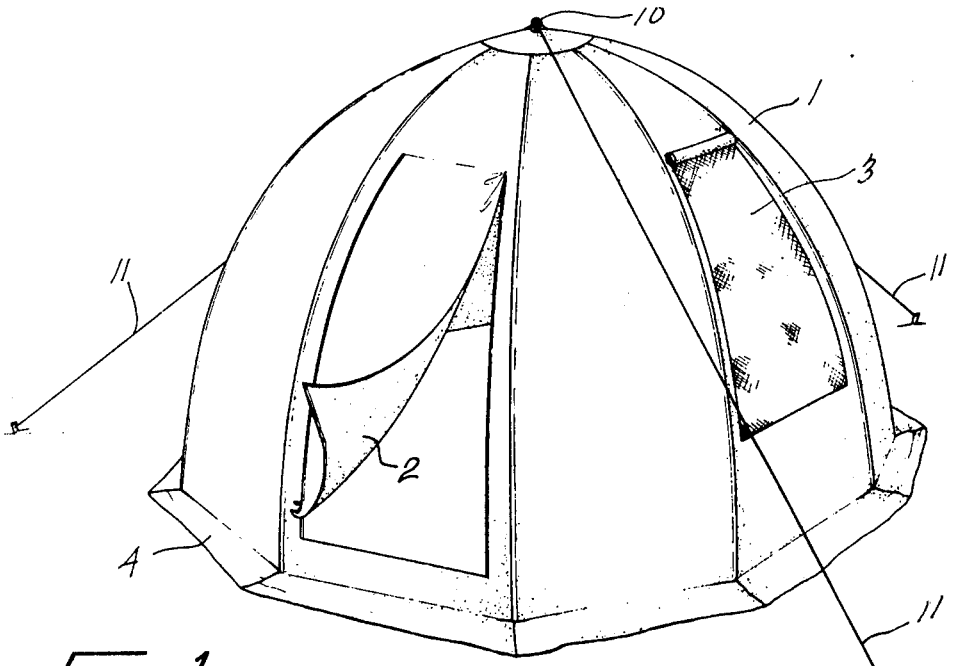
FIG. 1 is a perspective view of an umbrella tent according to the present invention, shown complete with the canvas in installed position.
Figure 7:
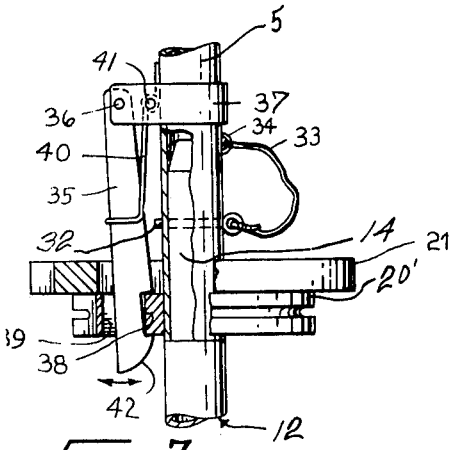
Figure 4:
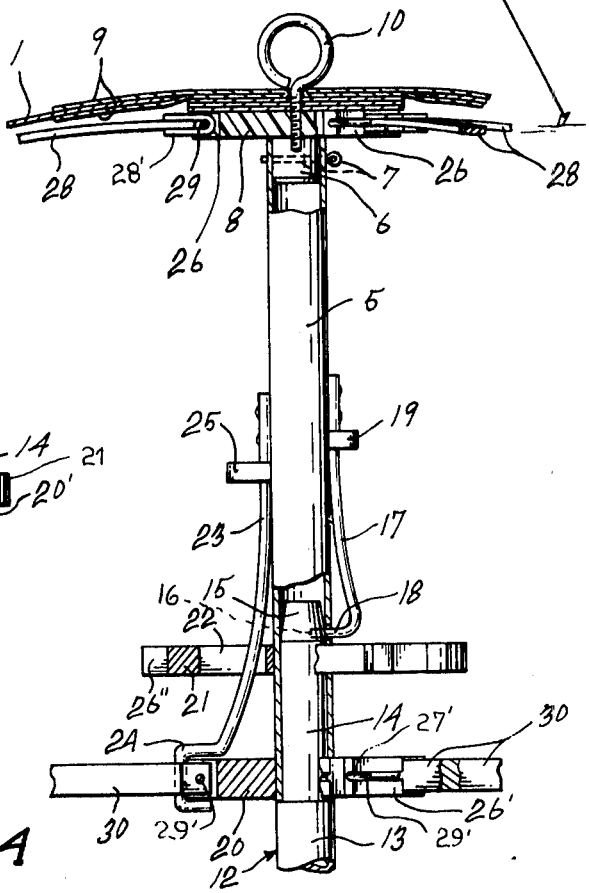
Figure 2:
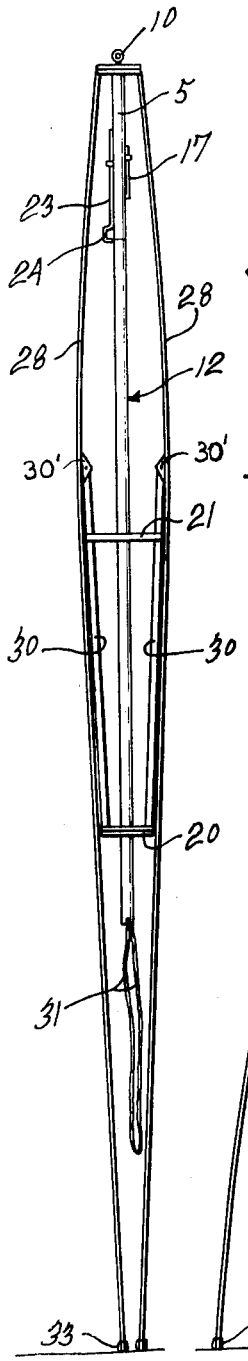
FIG. 2 is a side view of the framework structure alone shown in folded or collapsed position.
Figure 5:
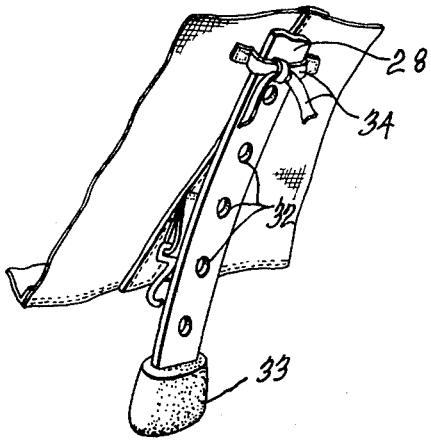
Figure 3:
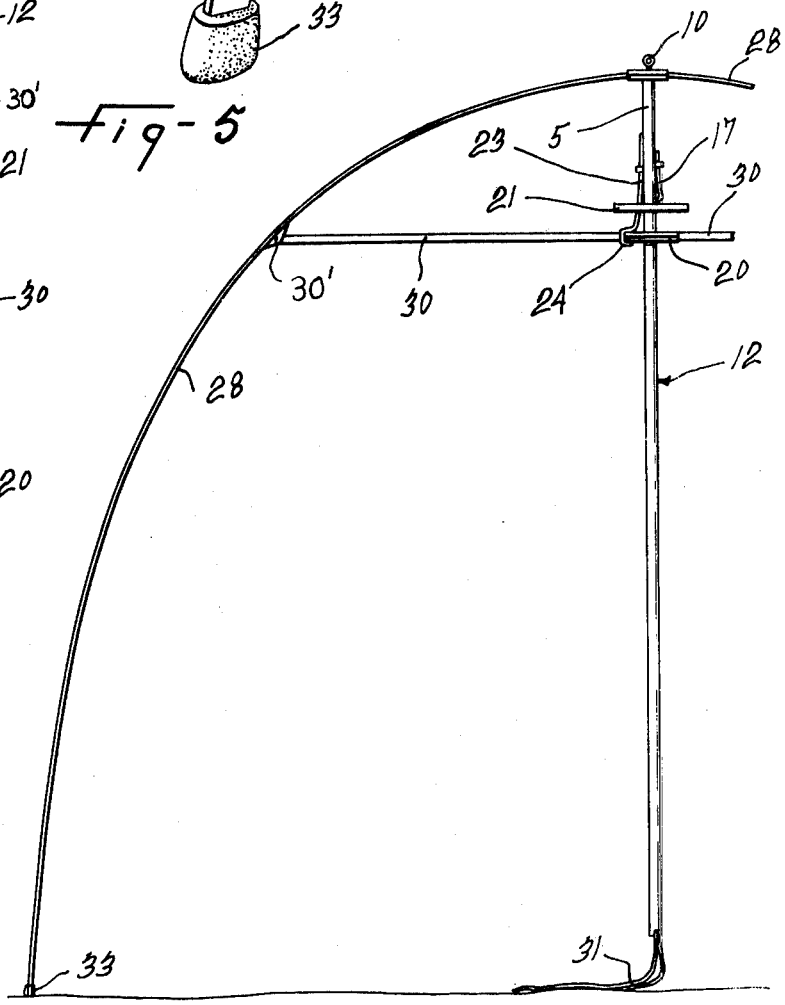
FIG. 3 is a partial side elevation view of the framework structure of FIG. 2 but shown here in open position.
Figure 6:
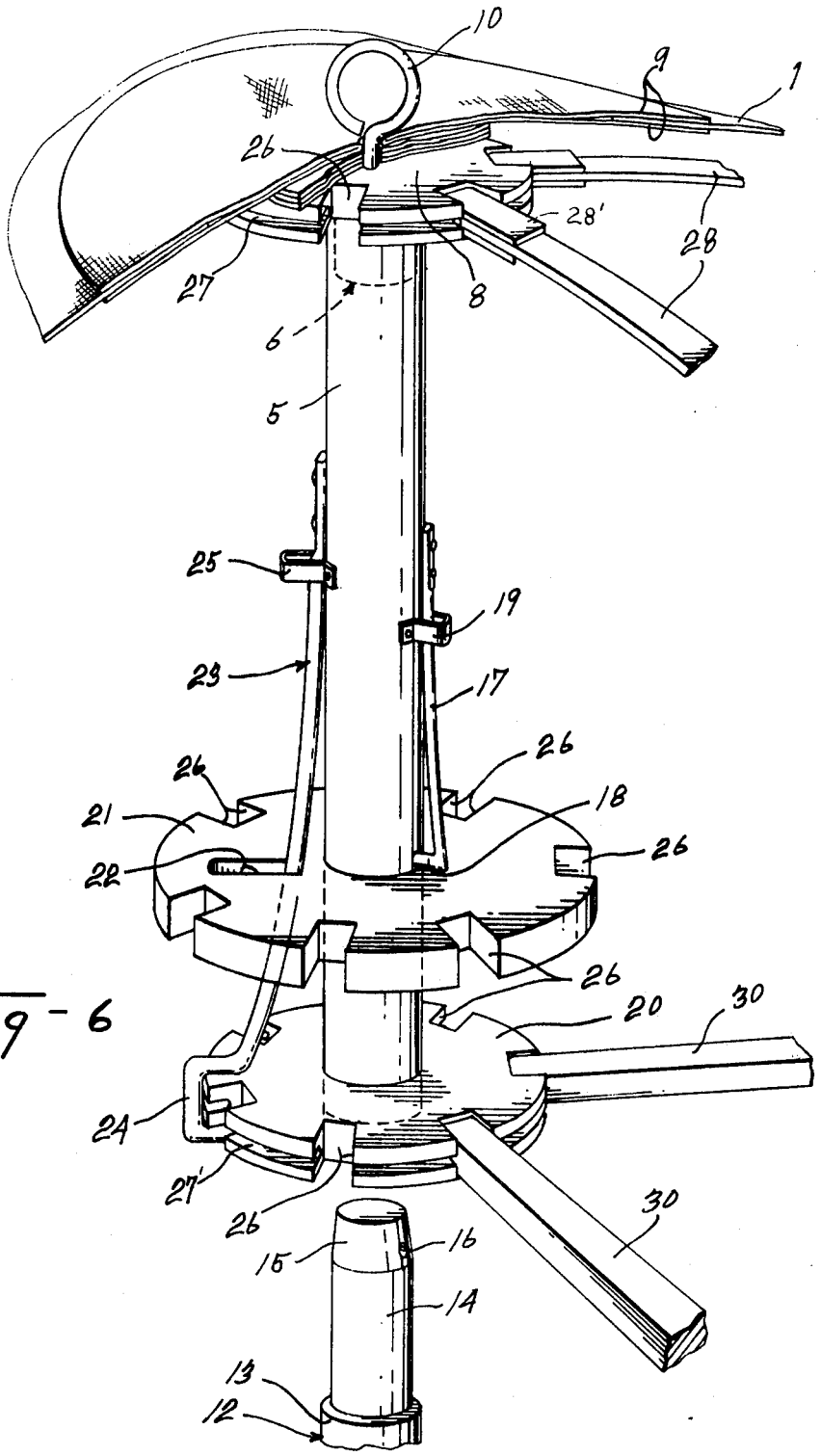

FIG. 4, one the same sheet as FIG. 1, is a detail view in enlarged scale of the central post and the associated elements;

FIG. 5, on the same sheet as FIGS. 2 and 3, is a detail perspective view illustrating the adjustable attachment of the peripheral edge of the canvas shell to the lower end of a supporting rib, FIG. 6 is an enlarged scale perspective view of the elements shown in FIG. 4; and FIG. 7 is a partial elevation of the central post and post extension showing another embodiment.

The illustrated umbrella tent includes a canvas shell 1, of dome shape configuration, adapted to rest over an internal framework structure, with the latter constituting the subject of the present invention. The shell 1 is shown with a door flap 2, a window 3 and a peripheral ground edge 4, but the details of these elements do not form part of the present invention and may thus be of any known construction. The shell 1 may also be made of any conventional tent material and with or without an integral floor.

The framework structure, as illustrated in FIGS. 2, 3, 4, and 6 includes a tubular central post 5, thus defining open top and bottom ends. A cylindrical plug 6 fits in the open top end of the central post and is secured by a locking pin or bolt 7. A spider ring 8, the shape of which is best shown in FIG. 6, is fixed to the plug 6 and thus is also axially fixed on top of the central post 5. The canvas shell 1 is centrally fixed onto the fixed spider ring 8 by means of reinforcing circles 9 of tent material. An eye bolt, or screw 10, is anchored into the fixed spider ring 8 and plug 6 and forms an external eye for attachment of guy ropes or strings 11 thereto, as shown in FIG. 1.

A tubular post extension 12 removably connects endwise into the open lower end of the central post 5. This tubular post extension has a main portion 13 of the same cross-sectional outline or external diameter as the central post. The tubular post extension 12 also has a reduced diameter upper end portion 14 slidably engaging in the open lower end of the central post. The free end of the upper end portion 14 is tapered at 15 to guide the insertion of the latter in the central post 5. The tapering end is formed with a transverse hole 16 therein.

An L-shape spring wire 17 has a longer portion secured against the central post 5 and extending lengthwise thereof and has a shorter portion 18 at the lower end of the longer portion. The shorter portion 18 is resiliently biased toward transverse engagement in a hole of the central post 5 registering with the hole 16 of the tapering end 15 when the post extension 12 is properly engaged in the tubular central post 5, as shown in FIG. 4. A U-shape bracket 19 is secured to the central post 5 in straddling relationship with the spring wire 17 to form a stop against undue outward bending of the spring wire.

An underlaying slidable spider ring 20 is slidably engaged around the central post 5 and slidable along the latter and along the post extension 12. An overlaying spider ring 21 is also slidably engaged around the central post 5 above the slidable spider ring 20. The overlying spider ring 21 functionally forms a spreader ring and, for this purpose, is of larger effective diameter than the slidable underlying ring 20. The spreader ring 21 is formed with a radial slot 22 therethrough.

A generally L shape hook member 23, formed of a spring wire, has a longer portion secured against the central post 5 and extending lengthwise of the latter. The L shape hook member 23 also includes a short portion 24 appropriately bent to form a hook for the edge of the slidable underlying ring 20, as best shown in FIGS. 4 and 6. This hook portion 24 is adapted to pass in the radial slot 22 of the slidable spreader ring 21. This hook member 23 is also resiliently biased toward hooking engagement with the edge of the slidable underlying ring 20. Another U-shaped clamp 25 is secured to the central post 5 in straddling relationship with the longer portion of the hook member 23 to restrict the outward bending of the latter.

The three spider rings 8, 20, and 21 are formed with radial notches 26, 26′, and 26″ respectively, spaced along the periphery thereof. The radial notches of one ring are arranged in vertical registry with the notches of the other rings. The fixed ring 8 and the slidable underlying ring 20 are each formed with a peripheral groove 27 and 27′ respectively in the edge thereof.

Ribs 28 are pivoted at an upper end in the radial notches 26 of the fixed ring 8 by means of a cord or wire 29 engaged in the corresponding peripheral groove 27 and extending through a loop 28′ fixed to rib 28. The ribs 28 extend radially to the central post 5. Rods 30 are pivoted at an inner end in a radial notch 26′ of the of the slidable ring 20 by means of a cord, or wire 29′ inserted in groove 27′ and passing through a hole of rod 30. The outer end of each rod 30 is pivoted at 30′ to an intermediate portion each of a corresponding rib 28. The ribs 28 are preferably formed of resilient flexible material to flex convexly according to the cut given to the canvas shell 1.

A loop 31, of cord, leather, rope, or the like is fixed to fixed to the lower end of the post extension 12 to form a stirrup device or foot-rest for engagement by one's foot. The stirrup device could be a transverse rod or bar fixed to the lower end of post extension 12 to serve as a foot-rest.

The lower end of each rib 28 is formed with perforations 32 and is provided with a rubber tip 33. Laces 34 are sewn to the canvas of the tent on the inner side and adjacent the peripheral edge. A hook 35 is also secured in registry with each rib 28 to adjustably attach the peripheral edge of the shell 1 to one of the available perforations 32.

The user opens the tent by reaching under the canvas shell 1, the framework structure which then stands as shown in FIG. 2. He grasps ring 20 with his hands and places one foot in the stirrup loop 31 and he forces the slidable ring 20 upwards with his hands and simultaneously pulls post extension 12 downwards with his foot. The ribs 28 are thus forced apart by the outward action of the rods 30 and they are forced to flex convexly outward by the canvas. When the rods 30 reach the level position of FIG. 3, the hook member 23 is engaged with the edge of the slidable ring 20 and holds the latter, as best shown in FIG. 4, that is, at the lower end of the central post 5. The post extension 12 has thus been freed or disengaged by the rings 20 and 21 and it is removed by releasing the spring wire 17 from locking engagement therewith. Then, there is no central post occupying the internal floor space of the tent.

It must be noted, as shown in FIG. 2, that when the tent is closed or collapsed, the two rings 20 and 21 are positioned along the then required extension 12. Spreader ring 21 freely slides downwardly during closing of the tent structure until the arms or rods 30 abut in the corresponding radial notches 26 of the spreader ring 21. The latter is of large diameter relative to the ring 21 to hold the rods 30 slightly inclined outwardly, as in FIG. 2, in readiness to produce on outward opening force on the ribs 28.

The collapsed tent forms a compact slender arrangement which is easy to carry and convenient for storage in a bag.

It must be noted that both the locking spring wire 17 and the hook member 23 are internally mounted and well within reach and actuation range of the person installing the tent. As the ring 21 is moved upward by ring 20, the hook member 23 normally automatically inserts itself through the radial slot 22 which is in register with member 23 and the latter is thereafter forced outwardly and made to engage with the ring 20.

In the embodiment of FIG. 7, the locking spring wire 17 of the first embodiment is replaced by a locking pin 32 removably engaged in registering holes of the central post 5 and post extension 12 and retained against loss by string 33 attached to pin 32 and to central post 5 at 34.

The locking hook 23 of the first embodiment is replaced by a spring-loaded plate-like latch or hook 35 pivoted at 36 to a collar 37 fixed to central post 5 above spreader ring 21. Hook 35 extends downwardly freely through radial slot 22 of spreader ring 21 and its lower end has a lateral notch 38 adapted to receive the radially inner end of a radial slot 39 made in the otherwise unmodified underlying slidable spider ring 20′. A wire spring 40 embraces hook 35 and is wound around a pin 41 carried by collar 37 and extends and rests against central post 5. Wire spring 40 urges hook 35 against central post 5 and its curved edge 42 causes automatic latching of the spider ring 20′ when the latter slides upward to its top limit position.

The embodiment of FIG. 7 operates in the same manner as the first embodiment.

The tent of the invention serves as a shelter for campers, as a fishing shindy, as a greenhouse when the shell is transparent or translucent. The shell can also be wholly or partly a screen material to exclude insects.

I claim:

1. An umbrella tent having a height that permits a person to stand upright inside the erected tent comprising a central post defining an upper end and a lower end, resilient one-piece ribs radially mounted around the central post and pivotally connected at their upper ends to the upper end of the central post for movement of each rib in a respective plane substantially coplanar with said post, a flexible tent cloth laid over said ribs and having a central portion attached to the upper end of said post and a peripheral portion attached to the lower ends of said ribs, a first ring surrounding the central post and slidable along the latter, rigid rods, equal in number to the number of ribs, radially projecting endwise around said first ring, and each defining an inner end pivotally connected to said first ring and an outer end pivotally connected to an intermediate portion of a respective one of said ribs, a post extension post and coaxial therewith and having an outside diameter substantially equal to the outside diameter of said central post, said first ring slidable along said central post and along said post extension during opening and closing movements of said tents, between an uppermost position at the lower end of said central post and a lowermost position intermediate the ends of said post extension, a foot-rest fixed to the lower end of said post extension and engageable by one's foot for opening the tent by downward foot pressure exerted thereon while one's hands prevent downward movement of said first ring to thereby cause downward movement of said post extension and central post through said first ring and consequent spreading of said ribs to open-tent position, a locking device mounted on said central post near the lower end thereof and releasably holding said first ring in its uppermost position at the lower end of said central post with said rods and ribs outwardly pivoted to open-tent position, thereby allowing removal of the post extension cleared by the first ring, said ribs, in open-tent position, being maintained in a convex arc-shaped by the outward thrust of said rods on said intermediate portions of said ribs and the inward restraining force of said tent cloth exerted on the lower outer ends of said ribs, said ribs in open-tent position having a length to extend down and rest on the ground and said post extension, when fitted to said central post, terminating above ground level, and further including a spreader ring slidably mounted on said central post and said post extension, overlying said first ring and independent of the same, and spreading ring having a larger effective diameter than that of said first ring and taking a position just above said first ring in the open-tent position with said rods in substantially horizontal position underneath said spreader ring, movement of said first ring downwardly along said central post and said post extension to collapse the tent allowing downward sliding movement of said spreader ring along said central post and said post extension until said spreader ring is engaged by said rods, so that said spreader ring takes, in the fully collapsed position of said tent, an intermediate position along said post extension wherein it is spaced well above said first ring and forms an inward abutment for said rods to maintain said rods in a limit collapsed position wherein they are upwardly and outwardly inclined from said first ring to facilitate subsequent opening of said tent, said locking device comprises an elongated hook member having one end attached to the central post and the other end releasably hooking the first ring in said uppermost position to said central post in the open-tent position, said spreader ring being formed with an aperture therethrough and through which freely extends said elongated hook member in the open-tent position.

* * * * *